US006240913B1

(12) United States Patent
Snell

(10) Patent No.: US 6,240,913 B1
(45) Date of Patent: Jun. 5, 2001

(54) SPLITTING MACHINES

(76) Inventor: Thomas Bartlett Snell, Gable Cottages, Charlton Horchthorn, Sherborne, Dorset, DT9 4NS (GB)

( * ) Notice: Subject to any disclaimer, the term of this patent is extended or adjusted under 35 U.S.C. 154(b) by 0 days.

(21) Appl. No.: 09/317,121

(22) Filed: May 24, 1999

(51) Int. Cl.[7] ..... B28D 1/26
(52) U.S. Cl. ..... 125/23.01; 125/35
(58) Field of Search ..... 125/23.01, 35, 125/40; 225/104

(56) References Cited

U.S. PATENT DOCUMENTS

| | | | | |
|---|---|---|---|---|
| 2,523,601 | * | 9/1950 | Swift | 125/23.01 |
| 2,950,710 | | 8/1960 | Lenhart | 125/23 |
| 2,974,661 | * | 3/1961 | Mayer | 125/23.01 |
| 3,937,260 | | 2/1976 | Anderson | 144/193 |
| 3,974,867 | | 8/1976 | Butas, Jr. | 144/193 |
| 4,192,364 | | 3/1980 | Findley | 144/193 |
| 4,250,863 | | 2/1981 | Gagnon et al. | 125/23 |
| 4,273,171 | | 6/1981 | Spaulding, Sr. | 144/193 |
| 4,314,591 | | 2/1982 | Pierrat | 144/193 |
| 5,289,816 | | 3/1994 | Rakowski | 125/23.01 |

FOREIGN PATENT DOCUMENTS

| | | | | |
|---|---|---|---|---|
| 470896 | | 3/1973 | (AU) . | |
| 1084814 | | 9/1980 | (CA) . | |
| 0098442 | * | 7/1897 | (DE) | 125/23.01 |
| 830473 | | 2/1952 | (DE) . | |
| 2254039 | | 9/1992 | (GB) . | |
| 1364489 | * | 1/1988 | (SU) | 125/23.01 |

* cited by examiner

*Primary Examiner*—Robert A. Rose
(74) *Attorney, Agent, or Firm*—Blank Rome Comisky & McCauley, LLP

(57) ABSTRACT

A splitter for splitting stone, concrete, wood and the like comprising a frame (21), a first splitter blade (24) moveable relative to the frame (21), a second splitter blade (23), and hydraulically actuatable means (26, 27) for pulling the first splitter blade (24) towards the second splitter blade (23) to effect said splitting. The hydraulically actuatable means (26, 27) preferably acts on end portions of the first blade (24) to provide increased leverage for the splitting operation. The first blade (24) is preferably provided with centering means (32, 28, 29, 31) for urging the first blade (24) into a central position when it has been moved to one side during the splitting operation.

8 Claims, 5 Drawing Sheets

SPLITTING MACHINES

This invention concerns machines for splitting pieces of stone, concrete, wood and the like.

Natural stone used by builders and stone masons to build walls and other structures often has to be split to provide it with a flat face with a visually pleasing appearance. Furthermore, as quarried, in addition to providing it with a flat face such stone usually needs to be split to make it of a size which is convenient for the intended end use.

In addition to splitting new stone, recycled stone obtained from demolishing existing buildings often needs to be split to reduce it to a desired size, in addition to refacing the stone, before it is used again.

Stone splitters have been proposed hitherto which consist of a rigid rectangular frame within which operates a vertically acting guillotine blade for splitting the stone, the blade being moveable between vertical guides by a pair of hydraulic rams which force the blade vertically down on to the stone, the stone resting on a horizontal surface formed by the frame or on another blade.

Such stone splitters suffer from a number of disadvantages. In particular, their mechanical lay out requires them to be upright and they are as a result high due to the downwardly acting rams. Additional height results from bringing the bottom blade and table to a convenient working height. Transporting such a device from site to site or even around a site requires it to be laid on its side or capable of being hinged about its mid-point in order to lower its center of gravity. Such splitters are generally transported from site to site as a horizontally trailed unit, and so they may incorporate wheels and a draw bar so that they are in effect trailers which can be towed to and set up at the next location. These splitters are unwieldy, and setting them up is labor intensive and sometimes potentially dangerous owing to their high centers of gravity.

A further problem with these prior art splitters is that the guide system for the moveable blade is limited so that attempting to split stones which are not flat topped can result in distortion of the frame work of the splitter or the splitters have to be provided with massive frames which resist the distortion. Furthermore, they are in general unable to accommodate wedge-shaped stones with anything other than small wedge angles. Thus these prior art splitters are limited in that the maximum force that can be applied is essentially limited to the hydraulic pressure of the ram used to activate the splitter blade, there being substantially no mechanical advantage from leverage.

All of the above results in heavy, unwieldy machines that are difficult to transport around a site and when being moved from site to site as a trailer require the use of a towing vehicle which is not favored as it adds to costs and occupies a vehicle which might be used for other purposes. These machines are unable to handle many misshapen stones satisfactorily due to the splitter blade not making sufficient contact with such stones which can lead to uneven splitting. Furthermore, the maximum splitting force is substantially that which can be applied by the hydraulic rams.

According to the present invention there is provided a splitter for splitting stone, concrete, wood and the like comprising a frame, a first splitter blade moveable relative to the frame, a second splitter blade, and hydraulically actuatable means for pulling the first splitter blade towards the second splitter blade to effect said splitting.

The hydraulically actuatable means preferably comprises two hydraulic rams, each attached to opposite end portions of the first blade. The first splitter blade is preferably moveable laterally relative to the second splitter blade substantially in the line of the said blades. The first splitter blade is preferably guided so that it is substantially prevented from rotating other than in a vertical plane, for example using polymeric or metal guides attached to the frame.

The first blade is preferably attached to centering means for centering the first blade relative to the second blade, the centering means preferably including slides or rollers urged by a spring into engagement with a frame of the splitter. The slides or rollers are preferably urged by separate springs.

An end portion of the first blade preferably includes means for limiting transverse movement of the first blade relative to the second blade, the means for limiting transverse movement of the first blade relative to the lower blade preferably comprising a pair of rollers attached to opposite end portions of the first blade, said movement being limited by engagement of one other pair of slides or rollers with the frame of the splitter.

Pivot means are preferably provided on or attached to the frame of the splitter so that the first blade can rotate on the pivot means about one or other end of the blade to effect said splitting.

Embodiments of stone splitters in accordance with the present invention will now be described with reference to the accompanying diagrammatic drawings in which.

Figure 1:
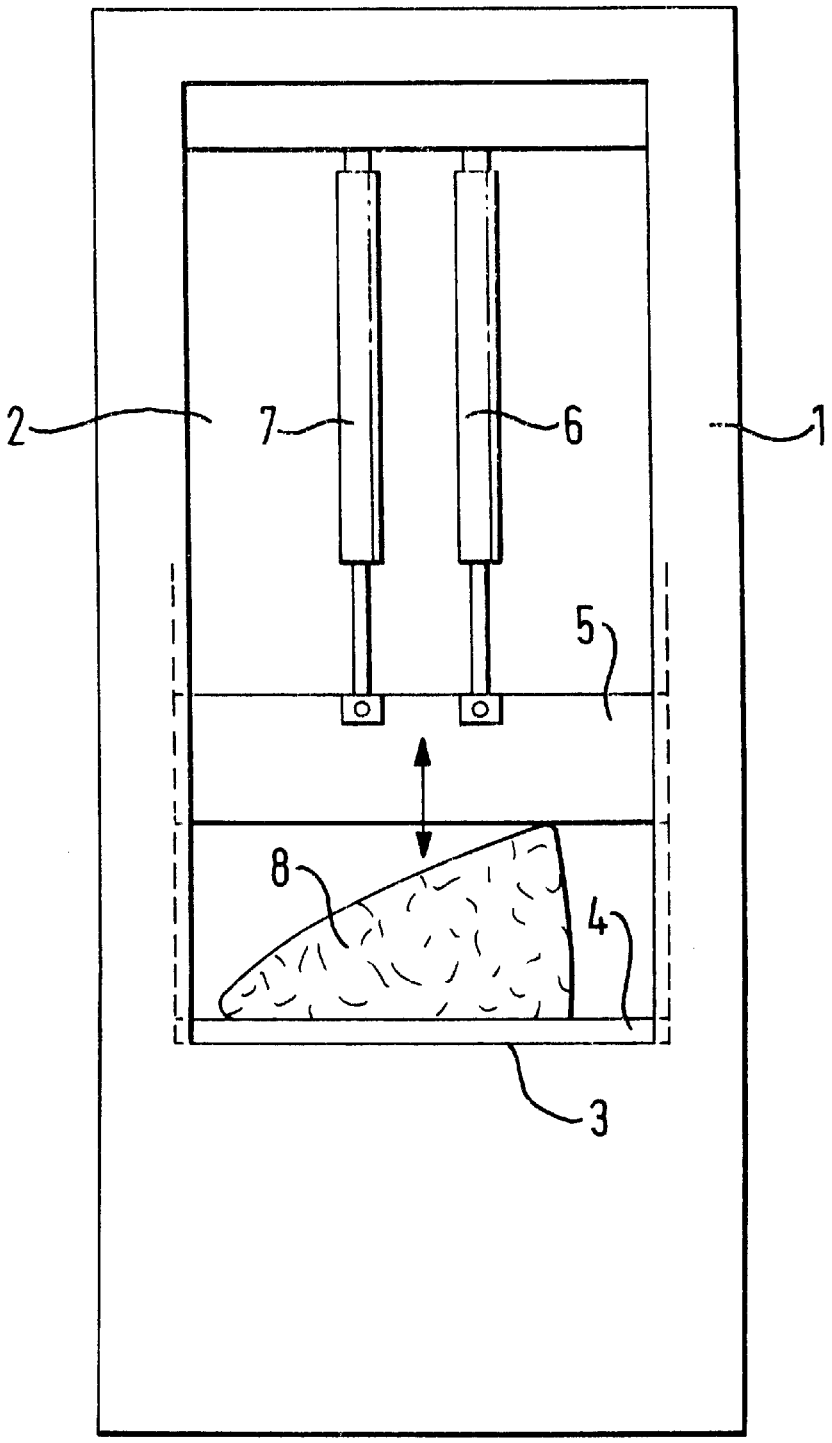
FIG. 1 (PRIOR ART)
FIG. 1 is a front view of a prior art stone splitter.
Figure 2:
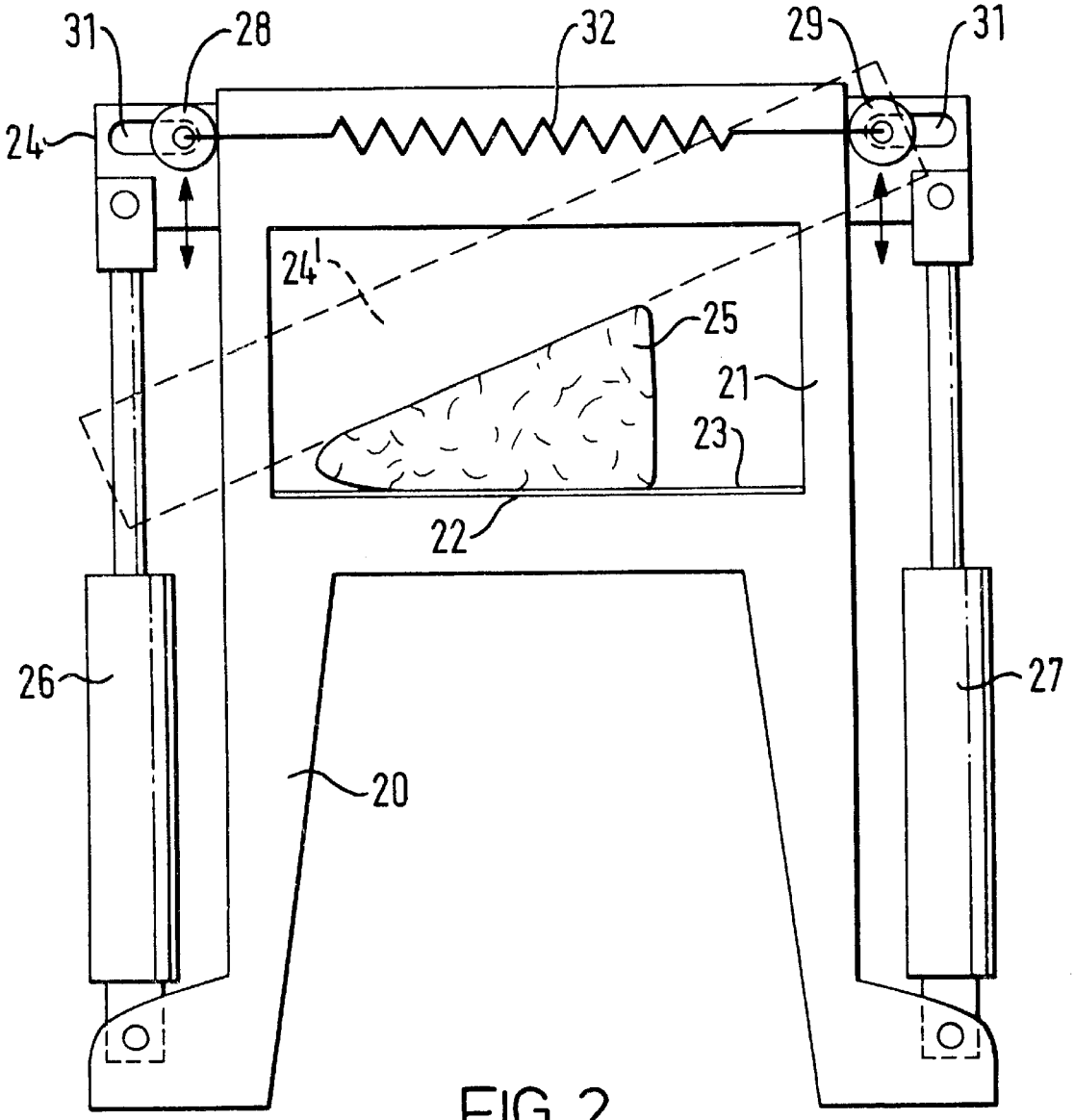
FIG. 2 is a front view of a first embodiment of stone splitter in accordance with the present invention being used to split a wedge-shaped stone.
Figure 2A:
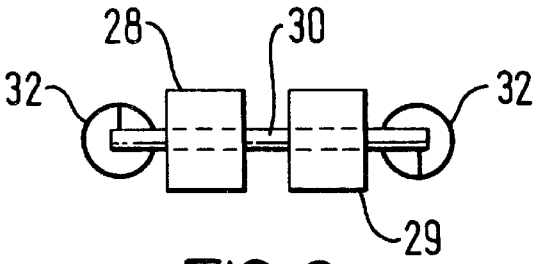
Figure 3:
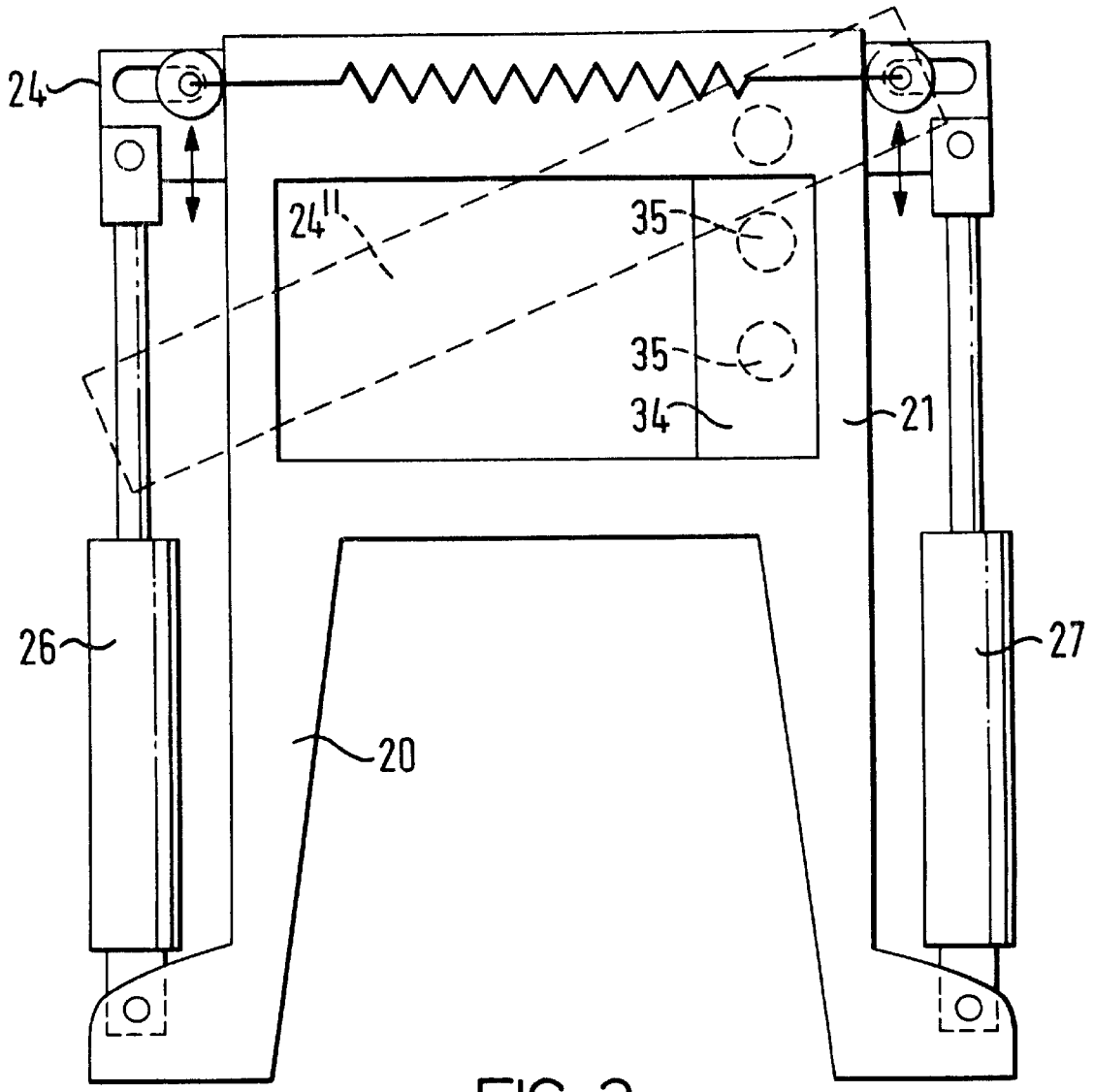
Figure 4:
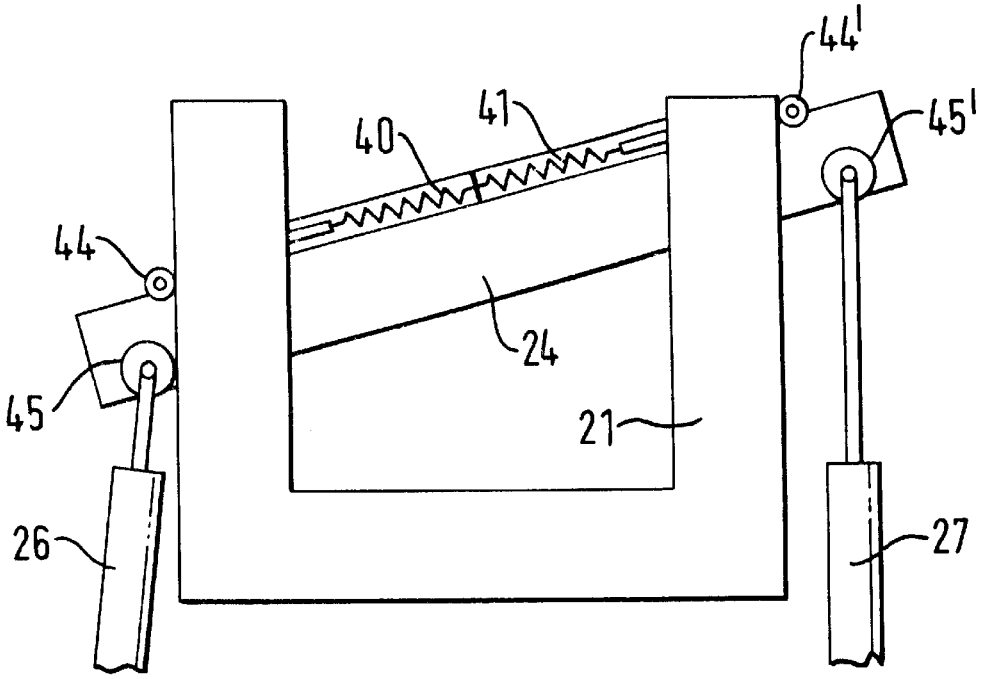
Figure 5:
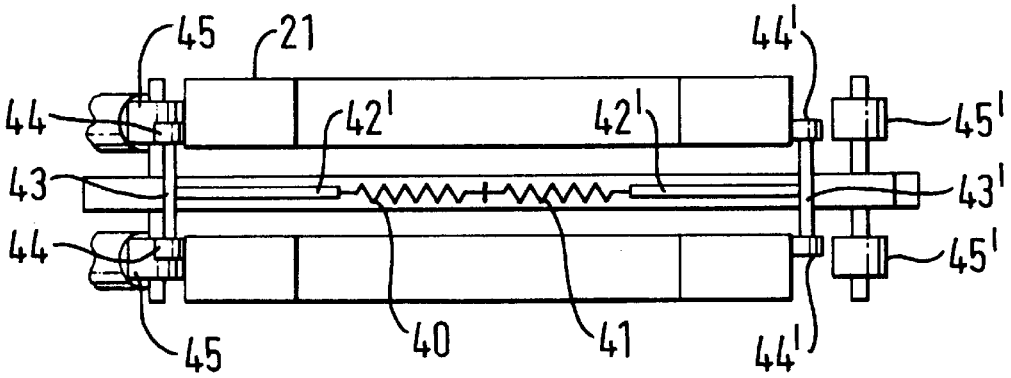

FIG. 2*a* is a detail of part of the embodiment of FIG. 1;

FIG. 3 is a modification of the embodiment of FIG. 2;

FIG. 4 is a front view of part of a second embodiment of stone splitter in accordance with the present invention;

FIG. 5 is a view of the embodiment of FIG. 4 from above; and

Figure 6:
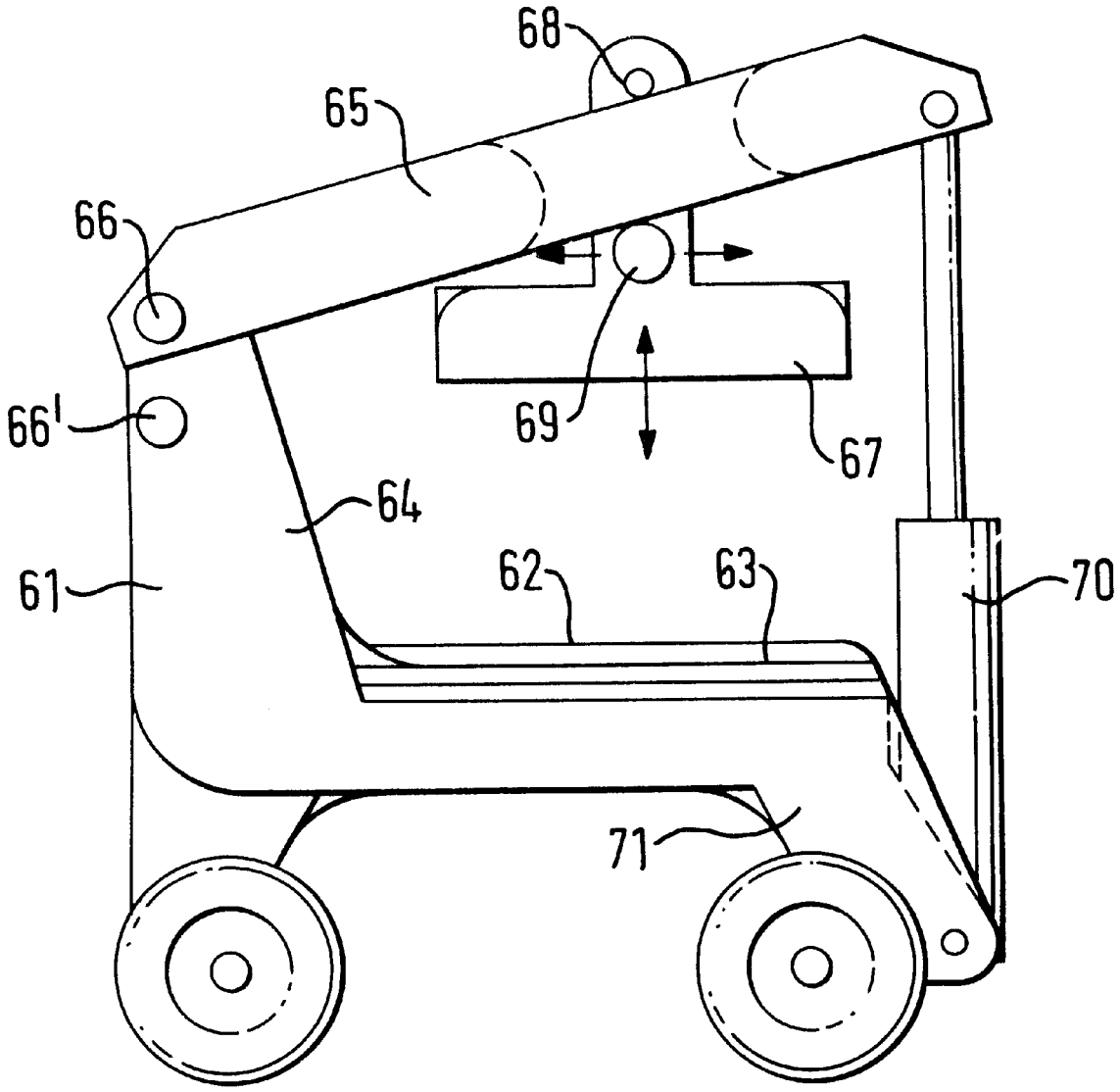

FIG. 6 is a front view of a third embodiment of stone splitter in accordance with the present invention.

The problems with the prior art stone splitters referred to above can be seen more clearly with reference to FIG. 1. Thus the illustrated splitter has a massive frame 1 with a rectangular aperture 2 within which stone splitting is effected. The base of the aperture forms a table 3 which includes a lower splitter blade 4. The splitter also includes an upper splitter blade 5 which is moveable within guides 9 in the frame 1 under the action of two hydraulic rams 6 and 7. The frame 1 is clearly large and unwieldy, with a high center of gravity, as it has not only to be strong enough to react against the splitting force applied by the rams 6 and 7, it also has to accommodate these rams within the aperture 2.

A wedge-shaped stone 8 to be split is shown positioned on the table 3 with its lower surface resting on the blade 4, the upper blade 5 being shown horizontal. Activation of the rams 6 and 7 brings the blade 4 into contact with the upper surface of the stone 8. However, the maximum force which can be applied to the stone 8 at the point of contact of the blade 4 with the stone 8 is substantially the downward force applied by the rams 6 and 7. Furthermore, due to the wedge shape of the stone 8, rotation of the blade 4 to bring it into contact with more of the stone 8 results in the blade 5 becoming wedged in one of the guides 9 with the result that the blade 5 tends to be restricted from further movement.

Referring to FIG. 2, the first point to note is the substantial difference in shape between this splitter in accordance with the present invention and the prior art splitter shown in FIG. 1.

The splitter in FIG. 2 has a base 20 which is integral with a rectangular frame 21 within which is a table 22 and a lower splitter blade 23. An upper blade 24 is located in guides formed in the frame 21 so that it can be brought down into contact with a stone 25 which is to be split using downwardly acting hydraulic rams 26 and 27. The rams 26 and 27 each connected between the base 20 and the blade 24. Splitting of the stone 25 is then effected by actuating the rams 26 and 27, splitting being effected by pulling the blade 24 down on to the stone 25 against the lower blade 23 rather than by pushing the blade 5 on to the stone 8 as is used in the prior art splitter shown in FIG. 1. The new position of the blade is shown at 24'.

As will be seen from FIG. 2, the blade 24 can take up any of a wide range of angles relative to the lower blade 23 without jamming such as can occur with the blade 5 in FIG. 1. However, sideways movement of the blade 24 relative to the frame 21 is restricted by two pairs of rollers 28 and 29 which each have an axle 30 which connects the rollers of each pair. The axles 30 are located in slots 31 in the two outer end portions of the blade 24, the rollers 28 and 29 being biased towards each other by two springs 32, one being on either side of the frame 21, so that the rollers are in rolling contact with opposing external vertical surfaces of the frame 21. The slots 31 allow the blade 24 to take up a variety of angular positions within the aperture formed by the frame 21 and the table 22, the axles 30 in the slots 31 combined with the rollers 28 and 29 running on the external surface of the frame 21 preventing the blade 24 from being displaced beyond a predetermined point in either sideways direction. The arrangement of the rollers 28, 29 in relation to the axle 30 and the springs 32 can be seen from FIG. 2*a*, a number of parts including the blade 24 having been omitted for clarity.

Splitting of the stone 25 is effected by bringing the blade 24 down into engagement with its upper surface, this being at a significant angle to the horizontal as a result of the wedged shape of the stone 25, the necessary downward movement being obtained by activating the rams 26 and 27. Additional displacement of the blade 24 to the left as shown in FIG. 2 will result, but this is restricted by contact of the rollers 29 with the external surface of the frame 21, the axle 30 then sliding in the slot 31 until further lateral movement of the blade 24 is prevented.

The force applied to the ram 27 can then be increased, the force applied to the stone 25 itself being increased further still as a result of the leverage obtained from the relative positions of the points of attachment of the rams 26 and 27 to the point of contact of the blade 24 with the stone 25.

FIG. 3 shows a modification of the embodiment of FIG. 2 in which the frame 21 includes a support member 34 having a series of holes 35 through which a pivot bar (not shown) can be inserted through a hole in the blade 24. The result is that the blade 24 can then pivot about the locating bar by the action of the ram 26. Particularly good leverage can then be achieved in applying a splitting force to the stone 25 since the splitting action is working about the locating bar rather than the pivot at the end of the ram 27, the blade being rotated to the position indicated by broken lines at 24".

An alternative guide and centering mechanism for the blade 24 is shown in FIGS. 4 and 5. Instead of having two springs 32 located outside the frame 21 which urge the pairs of rollers 26 and 27 towards each other and thereby through the axles 30 and the slot 31 center the blade 24, the mechanism shown in FIGS. 4 and 5 has a pair of springs 40, 41 which are attached to the top center of the blade 24, the springs 40 and 41 being connected by rods 42, 42' to axles 43, 43' each of the axles 43, 43' having a roller 44, 44' at each end. The springs 40 and 41 together with the rods 42, 42' are within the thickness of the blade 24 and they are also within the thickness of the blade 24 inside a protective tube on the top of the blade 24. The rods 42 and 42' are preferably of square section and are guided so that they are prevented from rotating about their lengths.

The ends of the blade 24 shown in FIGS. 4 and 5 are pivotally connected to hydraulic rams 26 and 27 in a similar manner to that shown in FIGS. 2 and 3. However, each end of both of the pivots is provided with a guide roller 45, 45' which serves to limit lateral movement of the blade 24 and prevent tops of the rams 26 and 27 from being jammed in the slots in the frame 21 in which the blade 24 operates.

When the splitter shown in FIGS. 4 and 5 is used to cut a wedge-shaped stone the rams 26 and 27 are actuated to bring the blade 24 down on to the stone which is resting on the lower blade 23. As a result of the wedge shape of the stone, when the blade 24 contacts the stone it tends to be pulled not only downwardly in the slot in the frame 21 but also to one side in the direction of the apex of the wedge of the stone. This lateral movement is resisted by the springs of the centering and guide mechanism. However, if the sideways sliding force on the blade 24 is too strong for the spring 40 or 41 which is attempting to resist it, the pair of guide rollers 45 or 45' on that side of the blade 24 will be brought into contact with the external surface of the frame 21. The blade 24 is then prevented form further lateral movement whilst still being capable of vertical movement under the guidance of the rollers 45 or 45'.

FIG. 6 shows a further embodiment of stone cutter in accordance with the present invention. This embodiment has a frame 61 including a horizontal table 62 with a lower cutter blade 63 and a single upright 64 to which is pivoted an arm 65 via a pivot pin 66.

An upper splitter blade 67 in the shape of an inverted "T" is slideable in a slot in the arm 65, an upper pin 68 on the upright of the "T" serving to support the blade 67 on the arm 65 and a lower pin 69 serving to restrict upward movement of the blade 67. The pins 68 and 69 are, however, spaced apart sufficiently to enable the blade 67 to be rocked in a vertical plane on the arm 65, thereby allowing the blade 67 to take up positions other than with its splitting edge horizontal, for example when splitting wedge-shaped stones. The slot in the arm 65 however restricts the amount of sliding movement of the blade 67 along the arm 65.

A downwardly acting hydraulic ram 70 connected between the end of the arm 65 remote from the pivot 66 and a downward extension 71 of the table 63 is operable to pull the arm 65 and thereby the blade 67 downwardly so that the blade engages a stone which is to be split. The blade 67 then assumes an angular position depending on the shape of the stone to be split, further pressure applied to the hydraulic ram 70 being applied to the stone with mechanical advantage as a result of the leverage effect obtained with this system.

As can be seen from FIG. 6, the pivot pin 66 can be moved to a different position 66', for example to alter the leverage achieved by the splitter. Alternatively, the end of the arm 65 which is not connected to the ram 70 can be provided with vertical slide means with locking pins at predetermined heights. Height adjustment can, if desired, be assisted by hydraulic means following which the end of the arm 65 can be locked in position using a pin such as 66 and 66'.

In the various illustrated embodiments of the present invention, stones to be split are placed on a table over a bottom blade. The bottom blade will in general be fixed, but one or other side of the table relative to the lower blade will usually be sprung or be capable of being lowered if the stone is such that the lower blade cannot make contact with the bottom surface of the stone.

The table can be in the form of a grid or perforated to allow small cuttings and dust to fall away from the work area, thereby avoiding a build up of waste in the working area. Alternatively, the table can be such that when a stone has been split the rear of the table drops away allowing off cuts to be discharged, for example by hydraulic means which can be can be linked into the hydraulic system for the rams, and it can be made to happen automatically. This can also minimise the need to clear the work area by hand.

Stone splitters in accordance with the present invention can include or form part of stone handling systems which include conveyors, and mechanical grabs and arms.

Hydraulic power to operate stone splitters in accordance with the present invention can be supplied by an integral or stand alone pump, or it can be supplied from some other source, for example a vehicle, e.g. a tractor.

Raising and lowering of the splitter blades will in general be effected using conventional hydraulic valves.

Although specifically described in relation to the splitting of stone, splitters in accordance with the present invention can be used to split other materials, for example concrete, artificial stone or wood. A particular use to which splitters in accordance with the present invention can be put is the accurate splitting of paving stones.

What is claimed is:

1. A splitter for splitting stone, concrete or wood comprising:

(a) a first splitter blade having a blade edge;

(b) a second splitter blade having a blade edge;

(c) guide means for guiding opposite end portions of the first splitter blade so that said first splitter blade is guided to move in a plane including the blade edge of said second splitter blade without such movement being restricted to parallel movement between the respective blade edges, the first splitter blade being moveable laterally relative to the second splitter blade substantially in the plane thereof; and (d) actuator means connected to the first splitter blade and arranged to pull both ends of the first splitter blade towards the second splitter blade to effect said splitting.

2. A splitter according to claim 1, including centering means for urging the first blade into a position centrally of the second blade, the first blade being attached thereto.

3. A splitter according to claim 2, wherein the centering means includes slides or rollers urged by a spring into engagement with a frame of the splitter.

4. A splitter according to claim 3, wherein each slide or roller is urged by a separate spring.

5. A splitter according to claim 1, wherein an end portion of the first blade includes means for limiting transverse movement of the first blade relative to the second blade.

6. A splitter according to claim 5, wherein the means for limiting transverse movement of the first blade relative to the second blade comprises a pair of slides or rollers attached to the opposite end portions of the first blade, said movement being limited by engagement of one or other pair of slides or rollers with the guide means.

7. A splitter according to claim 1, wherein the actuator means are connected to end portions of the first splitter blade distally of the end portions of the blade which are guided by the said guide means.

8. A splitter according to claim 1, wherein the actuator means comprises two hydraulic rams, each of the two rams being arranged to pull respective ends of the first splitter blade towards the second splitter blade to effect said splitting.

* * * * *